US007175799B2

(12) United States Patent
Hori et al.

(10) Patent No.: US 7,175,799 B2
(45) Date of Patent: Feb. 13, 2007

(54) PROCESS FOR PRODUCING HOLLOW MEMBER

(75) Inventors: Izuru Hori, Sayama (JP); Kouki Mizutani, Sayama (JP); Manabu Maruyama, Sayama (JP); Kenji Miyanaga, Sayama (JP); Yuji Kanai, Sayama (JP); Kazuo Isogai, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 303 days.

(21) Appl. No.: 10/490,465

(22) PCT Filed: Sep. 20, 2002

(86) PCT No.: PCT/JP02/09716

§ 371 (c)(1),
(2), (4) Date: Oct. 19, 2004

(87) PCT Pub. No.: WO03/028914

PCT Pub. Date: Apr. 10, 2003

(65) Prior Publication Data

US 2005/0046092 A1 Mar. 3, 2005

(30) Foreign Application Priority Data

Sep. 26, 2001 (JP) ..... 2001-294347

(51) Int. Cl.
*B29D 22/00* (2006.01)

(52) U.S. Cl. ..... 264/521; 264/532; 264/573

(58) Field of Classification Search ..... 264/521, 264/532, 573

See application file for complete search history.

(56) References Cited

U.S. PATENT DOCUMENTS 5,411,477 A * 5/1995 Saab ..... 604/103.13
6,852,267 B1 * 2/2005 Keller ..... 264/454

FOREIGN PATENT DOCUMENTS

| | | |
|---|---|---|
| JP | 61-245922 | 11/1986 |
| JP | 63-242429 | 10/1988 |
| JP | 05-076950 | 3/1993 |
| JP | 06-055226 | 3/1994 |
| JP | 10-230318 | 9/1998 |

* cited by examiner

*Primary Examiner*—Suzanne E. McDowell
(74) *Attorney, Agent, or Firm*—Carrier, Blackman & Associates, P.C.; William D. Blackman; Joseph P. Carrier

(57) ABSTRACT

A process is provided for producing a hollow member having a wall thickness, in a cross section orthogonal to the longitudinal direction, that varies in the longitudinal direction, the process including a heating step of heating a tubular material (Pa) so that the tubular material (Pa) is given a temperature variation in the longitudinal direction, and a stretching step of axially stretching the tubular material (Pa) that has been heated in the preceding step. In this way, a hollow member having a cross-sectional wall thickness that is variable in the longitudinal direction can be easily produced.

4 Claims, 12 Drawing Sheets

TUBE-EXPANDING (BULGE-FORMING) STEP

[FINAL HOLLOW MEMBER]

PARTIAL OHMIC HEATING STEP

OVERALL OHMIC HEATING STEP

STRETCH-FORMING STEP

TUBE-EXPANDING (BULGE-FORMING) STEP

[FINAL HOLLOW MEMBER]

INTERNAL PRESSURIZING AND STRETCH-FORMING STEP

TUBE-EXPANDING (BULGE-FORMING) STEP

INTERNAL PRESSURIZING AND STRETCH-FORMING STEP EMPLOYING MOLD

PROCESS FOR PRODUCING HOLLOW MEMBER

FIELD OF THE INVENTION

The present invention relates to a process for producing a hollow member having a wall thickness, in a cross section orthogonal to the longitudinal direction, that varies in the longitudinal direction, and also to a process for producing a hollow member having a shape, in a cross section orthogonal to the longitudinal direction, that varies in the longitudinal direction.

BACKGROUND ART

In general, hollow metal members are employed as components of industrial equipment, transport equipment, etc. and, for example, they are widely employed as frame members such as body frames or door frames in automobiles.

In recent years, accompanying demands for environmental protection measures, recycling, savings in resources, weight reduction, etc., the hollow members have employed a lightweight material such as an aluminum material, and there is also a desire for the development of a tubular member having its wall thickness and cross-sectional shape freely controllable in the longitudinal direction and having surplus material cut out so as to give an optimum wall thickness distribution, and a hollow member having an optimum cross-sectional shape in the longitudinal direction.

For example, Japanese Patent Application Laid-open No. 10-230318 discloses a process for producing a hollow member having cross-sectional shape variation in the longitudinal direction by bulge forming a hollow material that has been extruded using a die and a mandrel in combination.

Furthermore, Japanese Patent Application Laid-open No. 5-76950 and Japanese Patent No. 2874467 disclose processes for producing a hollow member in which, after a predetermined part of a tubular material having a uniform wall thickness is heated, the tubular material is compressed in the longitudinal direction so as to increase the thickness of the heated portion, thus giving a hollow member having a cross-sectional shape that varies in the longitudinal direction.

However, the process disclosed in Japanese Patent Application Laid-open No. 10-230318 is not only incapable of optimally controlling the wall thickness distribution in the longitudinal direction, but also requires special extrusion equipment in order to make the cross section of the hollow member variable, thereby giving rise to the problems of the equipment being large scale, the equipment cost being high, the productivity being poor, and the process being difficult to put into practice.

Moreover, in the processes disclosed in Japanese Patent Application Laid-open No. 5-76950 and Japanese Patent No. 2874467, since the tubular material is compressed in its longitudinal direction, there is the problem that a high precision product cannot be obtained because, for example, (1) there is a possibility that the tubular material might buckle, collapse, etc.
(2) it is difficult to make the circumference of the tubular material uniform along its whole length.

DISCLOSURE OF THE INVENTION

The present invention has been achieved under the above-mentioned circumstances, and an object thereof is to provide a novel process for producing a hollow member, the process enabling a hollow member having an optimum wall thickness distribution in the longitudinal direction to be easily produced and also enabling a hollow member having a cross-sectional shape that varies in the longitudinal direction to be easily produced.

Another object of the present invention is to provide a novel process for producing a hollow member, the process enabling the easy production of a hollow member having a desired wall thickness distribution in the longitudinal direction and a uniform circumference without constricted or expanded portions, or a hollow member having a cross-sectional shape that varies in the longitudinal direction.

In order to achieve the above objects, in accordance with a first aspect of the present invention, there is provided a process for producing a hollow member having a wall thickness, in a cross section orthogonal to the longitudinal direction, that varies in the longitudinal direction, the process including a heating step of heating a tubular material so that the tubular material is given a temperature variation in the longitudinal direction, and a stretching step of axially stretching the tubular material that has been heated in the preceding step.

In accordance with this first aspect, a hollow member having a cross-sectional wall thickness that is variable in the longitudinal direction can be easily produced.

Furthermore, in accordance with a second aspect of the present invention, there is proposed a process for producing a hollow member having a shape, in a cross section orthogonal to the longitudinal direction, that varies in the longitudinal direction, the process including a heating step of heating a tubular material so that the tubular material is given a temperature variation in the longitudinal direction, a stretching step of axially stretching the tubular material that has been heated in the preceding step, and a tube-expanding step of tube expanding an elongated tubular material, which has had its wall thickness in a cross section orthogonal to the longitudinal direction varied in the longitudinal direction in the preceding step, by setting the elongated tubular material within a cavity of a mold and applying an internal pressure to the elongated tubular material.

In accordance with this second aspect, a hollow member having a cross-sectional shape that varies in the longitudinal direction can be easily produced.

Moreover, in accordance with a third aspect of the present invention, there is proposed a process for producing a hollow member having a wall thickness, in a cross section orthogonal to the longitudinal direction, that varies in the longitudinal direction, the process including a heating step of heating a tubular material so that the tubular material is given a temperature variation in the longitudinal direction, and a stretching step of applying an internal pressure to the tubular material that has been heated in the preceding step and axially stretching the tubular material.

In accordance with this third aspect, a hollow member having a cross-sectional wall thickness that is variable in the longitudinal direction can be produced and, in particular, a hollow member having a substantially uniform circumference along its whole length without partial 'necking' can be produced precisely and easily by applying an internal pressure to the tubular material and axially stretching it.

Furthermore, in accordance with a fourth aspect of the present invention, there is proposed a process for producing a hollow member having a shape, in a cross section orthogonal to the longitudinal direction, that varies in the longitudinal direction, the process including a heating step of heating a tubular material so that the tubular material is given a temperature variation in the longitudinal direction, a stretching step of applying an internal pressure to the tubular material (Pa) that has been heated in the preceding step and axially stretching the tubular material, and a tube-expanding step of tube expanding an elongated tubular material, which has had its wall thickness in a cross section orthogonal to the longitudinal direction varied in the longitudinal direction in the preceding step, by setting the elongated tubular material within a cavity of a mold and applying an internal pressure to the elongated tubular material.

In accordance with the fourth aspect, a hollow member having a cross-sectional shape that varies in the longitudinal direction can be produced and, in particular, a hollow member having a substantially uniform circumference along its whole length without partial 'necking' can be produced precisely and easily by applying an internal pressure to the tubular material and axially stretching it.

BRIEF DESCRIPTION OF THE DRAWINGS

FIGS. 1 to 4 illustrate a first embodiment of the present invention;

FIG. 1 is a perspective view of a hollow member produced in accordance with the production process of the present invention;

FIG. 2 is a diagram showing production steps of producing a hollow member from a tubular material;

FIG. 4 is a cross-sectional view of a tube-expanding (bulge-forming) device.

FIGS. 6 to 10 illustrate a third embodiment of the present invention;

FIG. 6 is a perspective view of a hollow member produced in accordance with the present invention;

FIG. 7 is a diagram showing production steps of producing a hollow member from a tubular material;

FIG. 9 is a cross-sectional view of an internal pressurizing and stretch-forming device; and FIG. 10 is a cross-sectional view of a tube-expanding (bulge-forming) device.

BEST MODE FOR CARRYING OUT THE INVENTION

The first embodiment of the present invention is explained with reference to FIGS. 1 to 4.

The first embodiment is a case in which a hollow member having a substantially uniform cross-sectional wall thickness and an expanded tube portion is produced by variably controlling the cross-sectional wall thickness in the longitudinal direction of a tubular material Pa, which is made of an aluminum alloy and has a uniform cross-sectional wall thickness and a uniform diameter in the longitudinal direction, and then carrying out tube expansion (bulge forming), and this process specifically includes (1) a partial ohmic heating step for the tubular material Pa,
(2) an overall ohmic heating step for the tubular material Pa,
(3) a stretch-forming step for the tubular material Pa, and
(4) a tube-expanding (bulge-forming) step of an elongated tubular material Pb after stretching. These steps are explained in turn below.

Figure 3A:
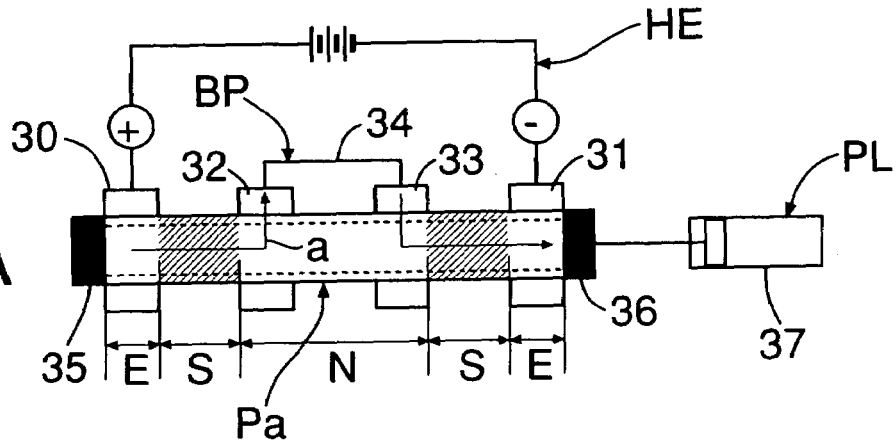
FIG. 3A, FIG. 3B, and FIG. 3C are diagrams showing steps of stretching a tubular material.

[(1) Partial Ohmic Heating Step for Tubular Material Pa] (see FIG. 3A)

The tubular material Pa, which has a uniform cross-sectional wall thickness and a uniform cross-sectional shape in the longitudinal direction and is made of an aluminum alloy, is heated in part in the longitudinal direction using heating means such as, for example, ohmic heating means HE. That is, electrically connected to opposite end portions of the tubular material Pa are a + electrode 30 and a − electrode 31 of the ohmic heating means HE, and disposed on the outer peripheral face of a middle portion of the tubular material Pa is current bypass means BP. This current bypass means BP is formed by electrically connecting two low resistance conductors (e.g., copper conductors) 32 and 33 having lower electrical resistance than that of the aluminum alloy to the longitudinally middle portion of the tubular material Pa so as to encircle it, the two conductors 32 and 33 having a spacing therebetween in the longitudinal direction, and connecting the low resistance conductors 32 and 33 to each other via a lead 34.

The tubular material Pa is provided with stretching means PL for axially stretching the tubular material Pa. This stretching means PL is formed from a fixed member 35 fixed to one end of the tubular material Pa, a movable member 36 fixed to the other end thereof, and a tensile actuator, that is, a tensile cylinder 37, connected to the movable member 36, and the tubular material Pa is stretched longitudinally in accordance with contraction of the tensile cylinder 37.

When the ohmic heating means HE is energized, current flows through the tubular material Pa, the bypass means BP, and then again through the tubular material Pa. That is, since the two low resistance conductors 32 and 33 have a lower electrical resistance than that of the tubular material Pa, which is made of an aluminum alloy, as shown by arrow a in FIG. 3A the current flows through the tubular material Pa while bypassing the hollow portion N of the tubular material Pa, the hollow portion N corresponding to a section between the two low resistance conductors 32 and 33. The portions S on longitudinally opposite sides of the tubular material Pa are therefore heated, and compared with the middle portion N the amount of heat generated therein is relatively large.

In this partial ohmic heating step, the stretching means PL for the tubular material Pa does not operate.

Figure 3B:
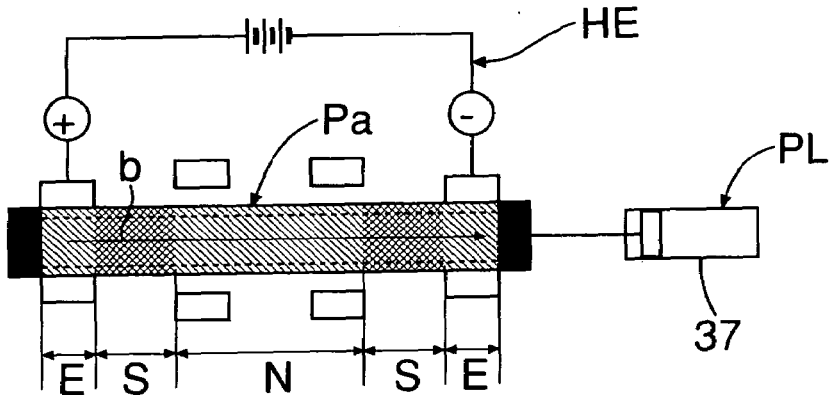

[(2) Overall Ohmic Heating Step for Tubular Material] (see FIG. 3B)

When the portions S on opposite sides of the tubular material Pa have been heated to a higher temperature than that of the middle portion N by the partial heating in the preceding step, the two low resistance conductors 32 and 33 of the current bypass means BP are detached from the tubular material Pa while continuing to operate the ohmic heating means HE. The + electrode 30 and the − electrode 31 of the ohmic heating means HE are thereby electrically connected through the whole length of the tubular material Pa, current flows through the tubular material Pa as shown by arrow b in FIG. 3B, and the tubular material Pa is ohmically heated along its whole length. By the above-mentioned two steps, the left and right portions S on opposite sides of the tubular material Pa are therefore heated to a high temperature, for example, the recrystallization temperature (500° C.) of the tubular material Pa or higher, whereas the middle portion N of the tubular material Pa is heated to a lower temperature.

In this overall ohmic heating step also, the stretching means for the tubular material Pa does not operate.

Figure 3C:
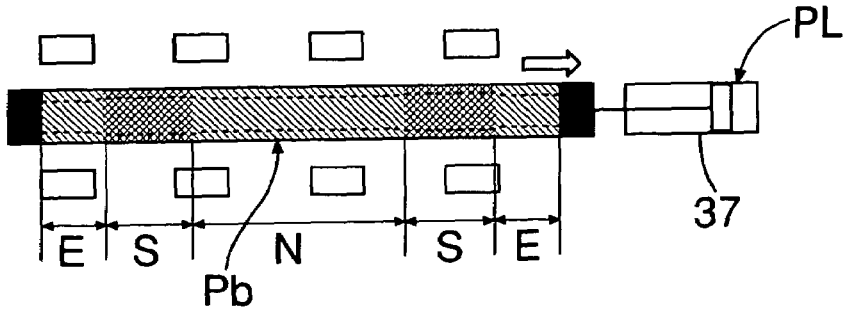

[(3) Stretch-forming Step for Tubular Material Pa] (see FIG. 3C)

Figure 1:
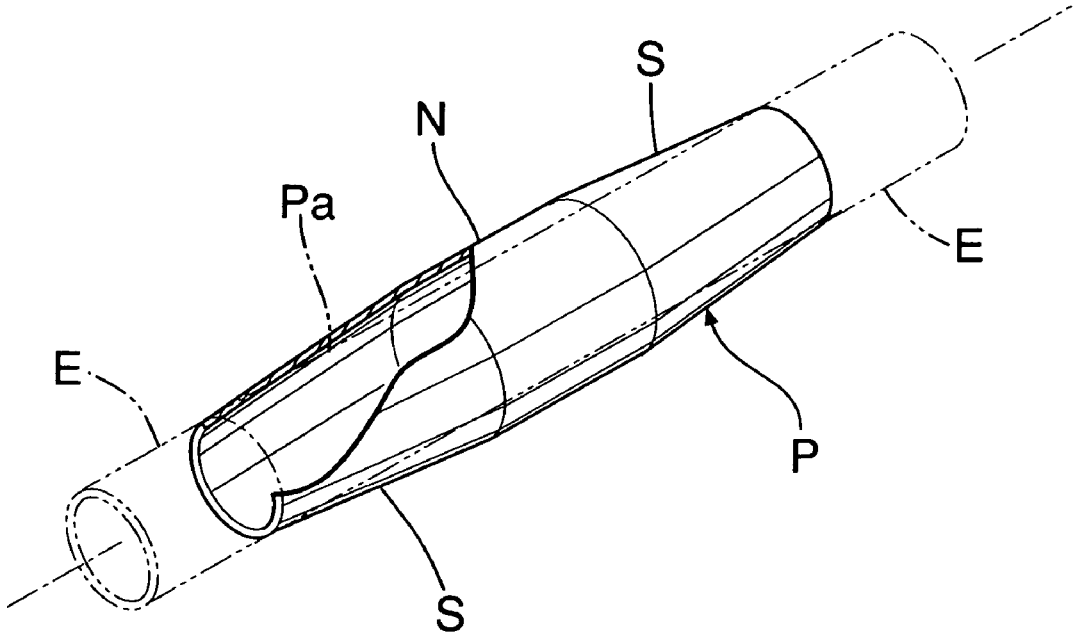
Figure 2:
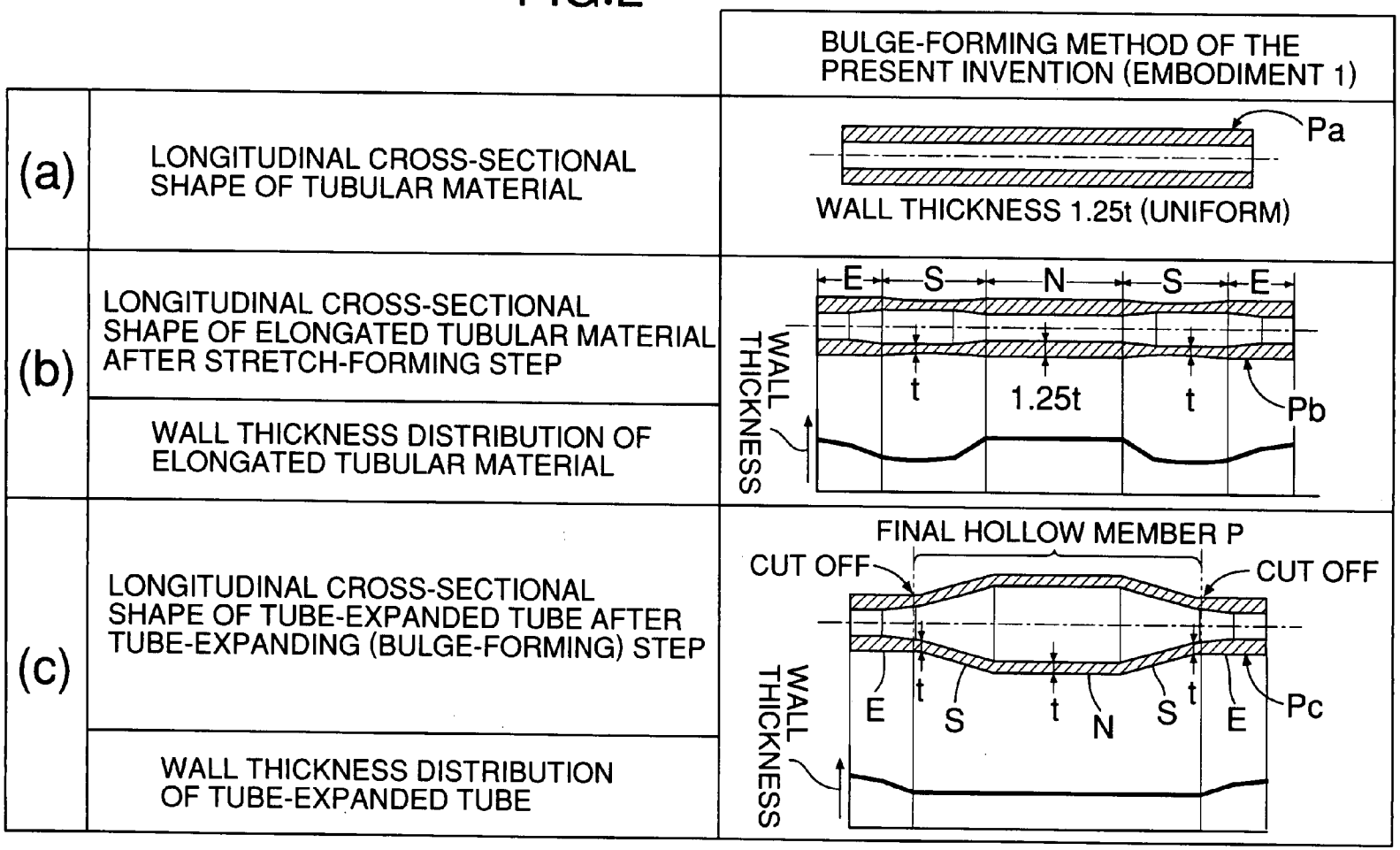

In the above-mentioned step, the left and right portions S on opposite sides and the middle portion N of the tubular material Pa are heated to a state where they have a predetermined temperature difference, and operating the stretching means PL applies a predetermined tension to the tubular material Pa in the axial direction. The tubular material Pa is thereby elongated in the axial direction; since the left and right portions S at opposite ends, which have been heated to a high temperature, have a small resistance to deformation, they elongate quickly and thus have a large amount of elongation, whereas since the middle portion N, which has been heated to a lower temperature, has higher resistance to deformation, it elongates slowly and thus has a small amount of elongation. As a result, as shown in FIG. 2 (*b*), the cross-sectional wall thickness in the hollow portion N of the tubular material Pb thus elongated in the axial direction is large, that is, 1.25 t, and the cross-sectional wall thickness of the left and right portions S on opposite sides, that is, t, is smaller than that of the hollow portion N. The cross-sectional wall thickness of the elongated tubular material Pb is thus variably controlled in the axial direction.

Figure 4:
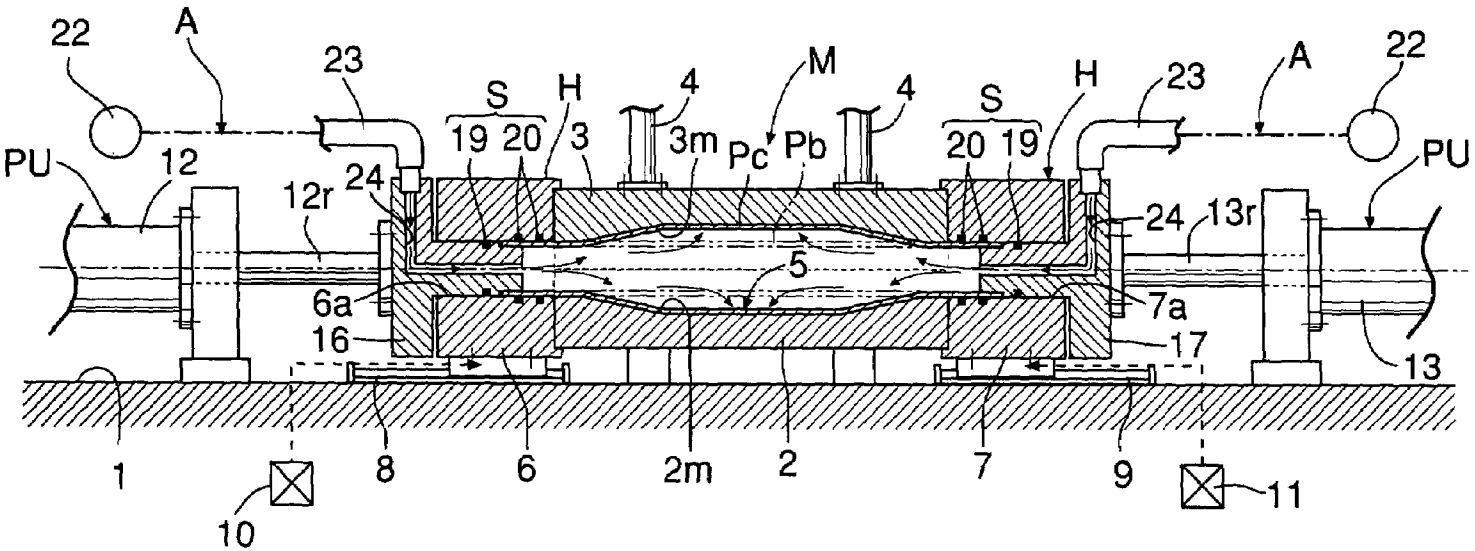

[(4) Tube-expanding (Bulge-forming) Step for Elongated Tubular Material Pb After Stretching] (see FIG. 4)

The elongated tubular material Pb, which has been elongated in the axial direction in the preceding step, is transferred to a tube-expanding (bulge-forming) device by appropriate transfer means.

As shown in FIG. 4, a mold M of the tube-expanding (bulge-forming) device comprises a fixed mold, that is, a lower mold 2, fixedly provided on a base 1, and a mobile mold, that is, an upper mold 3, which faces the fixed mold. Raise/lower cylinders 4 are connected to the top of the mold M, and the upper mold 3 is operated so as to be raised and lowered by expansion/contraction of the raise/lower cylinders 4.

The mold M is a tube-expanding mold and is for subjecting the elongated tubular material Pb, which has been axially elongated in the above step and maintained in a heated state (about 500° C.), to hot tube expansion (hot bulge forming) at the recrystallization temperature thereof or higher. This mold M is heated to about 500° C. by heating means, which is not illustrated.

Formed on the upper face of the lower mold 2 is a lower mold molding surface 2*m*, with which the lower half of the elongated tubular material Pb is molded. Formed on the lower face of the upper mold 3 is an upper mold molding surface 3*m*, with which the upper half of the elongated tubular material Pb is molded. A cavity 5 is formed by the molding surfaces 2*m* and 3*m* when the mold M is closed. Provided on opposite sides on the left and right of the mold M is holding means H for fixing the opposite end portions of the elongated tubular material Pb. The holding means H comprises left and right holders 6 and 7 on the left and right of the mold M; these holders 6 and 7 can be moved forward and backward relative to the mold M, and are controlled by the operation of actuators 10 and 11 so as to move along guides 8 and 9 provided on the base 1. By moving the left and right holders 6 and 7 forward, the opposite end portions of the elongated tubular material Pb are fitted into and fixed to support holes 6*a* and 7*a* of the left and right holders 6 and 7.

Furthermore, provided on opposite sides on the left and right of the mold M is pushing means Pu for axially pushing the elongated tubular material Pb set in the mold M. This pushing means PU has left and right pressure cylinders 12 and 13. Pressing members 16 and 17 secured to the extremities of rod portions 12*r* and 13*r* of these pressure cylinders 12 and 13 are fitted within the support holes 6*a* and 6*b* of the left and right holders 6 and 7 so as to be able to move forward and backward. When the left and right pressure cylinders 12 and 13 are extended, the extremities of the pressing members 16 and 17 engage with the corresponding opposite ends of the elongated tubular material Pb, and when the pressing members 16 and 17 subsequently move forward, the elongated tubular material Pb is pushed in the axial direction from the opposite ends thereof.

O-rings 19 and 20 as sealing means S are provided respectively between the left and right pressing members 16 and 17 and the support holes 6*a* and 7*a*, and between the support holes 6*a* and 7*a* and outer peripheral faces of the opposite end portions of the elongated tubular material Pb. These O-rings 19 and 20 can provide a fluid tight seal between the elongated tubular material Pb, the holders 6 and 7, and the pressing members 16 and 17 when the pressing members 16 and 17 are engaged with the elongated tubular material Pb.

Provided on opposite sides on the left and right of the mold M1 is compressed air supply means A for pressurizing the interior of the elongated tubular material Pb. This compressed air supply means A is arranged so that compressed air is supplied under pressure from a compressed air supply source 22 to a hermetically sealed hollow portion of the elongated tubular material Pb via a compressed air circuit 23 and an air introduction route 24 bored in the pressing members 16 and 17.

The elongated tubular material Pb, which has been elongated in the preceding step and is still in a heated state (about 500° C.), is placed and set within the mold M, which has been heated similarly to about 500° C., and the first mold M1 is clamped by means of the operation of a mold clamping cylinder, that is, the raise/lower cylinder 4. After opposite end portions of the elongated tubular material Pb are fixed by forward movement of the left and right holders 6 and 7, extending the pressure cylinders 12 and 13 makes the rod portions 12*a* and 13*a* thereof push the tubular material Pa in the axial direction, and pressurized air is supplied into the tubular material Pa from the compressed air source 22 via the compressed air supply route 23 and the air introduction route 24 while carrying out the axial pushing. Applying an internal pressure to the elongated tubular material Pb in this way subjects the elongated tubular material Pb to hot tube expansion (hot bulge forming) so that it follows the upper and lower molding surfaces 3*m* and 2*m* of the cavity 5.

The elongated tubular material Pb after tube expansion is taken out of the mold M by opening the mold M after the left and right holders 6 and 7 are moved backward, and a tube-expanded tube (bulge-formed tube) Pc is obtained as shown in FIG. 2 (*c*). In this way, this tube-expanded tube Pc is formed in a shape having an enlarged portion comprising the hollow portion N, left and right tapered and truncated cone portions comprising the left and right portions S on opposite sides, which extend leftward and rightward from the enlarged portion, and left and right end portions E, which extend from the cone portions and have not been subjected to tube expansion (bulge forming), and the left and right end portions E are cut off to give a final molding, that is, a hollow member P (see FIG. 1).

With regard to the elongated tubular material Pb, which has been subjected to the above-mentioned partial heating, overall heating, and stretch-forming steps described in (1) to (3), as shown in FIG. 2 (*b*), the cross-sectional wall thickness of the left and right portions S on opposite sides is t, and the cross-sectional wall thickness of the middle portion N is 1.25 t, which is thicker than t. By subjecting this elongated tubular material Pb to the tube expansion (bulge forming) of the above (4), as shown in FIG. 2 (*c*), the middle portion N thereof is radially elongated to a larger extent than that to which the left and right portions S on opposite sides are elongated, thus forming an enlarged diameter portion, and the tube Pc after tube expansion therefore has a substantially uniform wall thickness t along the whole length thereof as shown in FIG. 2 (*c*). As a result, the final molding after tube expansion, from which the left and right end portions E have been cut off, that is, the hollow member P, is a tube-expanded tube Pc having a substantially uniform cross-sectional wall thickness t along its whole length even though the cross-sectional shape has been changed by tube expansion. In accordance with this first embodiment, the defect of the conventional tube-expanding (bulge-forming) method, that is, the cross section of the bulge-formed portion becoming thin, can be eliminated.

A second embodiment of the present invention is now explained with reference to FIG. 5.

Figure 5:
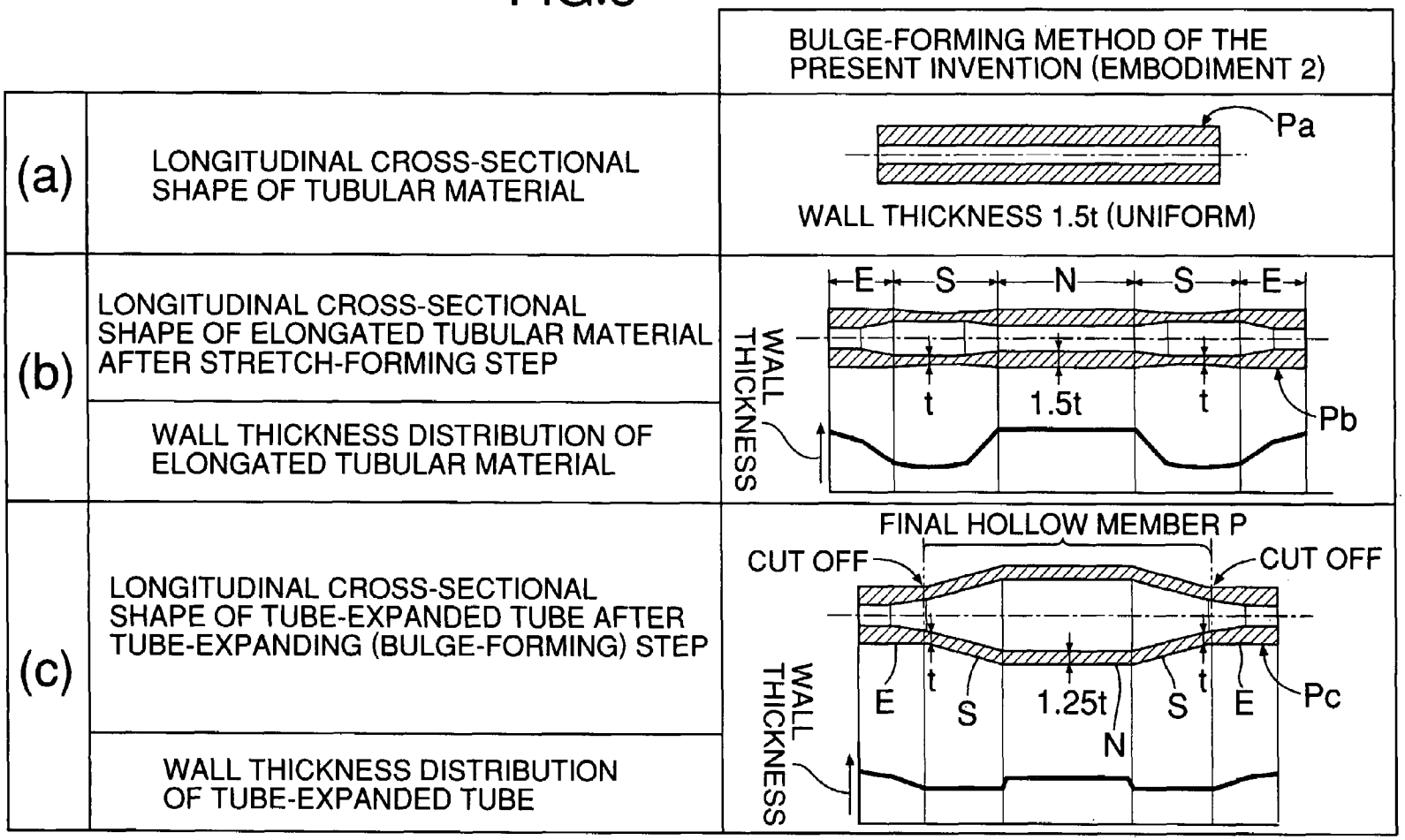
FIG. 5 shows a second embodiment of the present invention and is a diagram showing production steps of producing a hollow member from a tubular material.
Figure 6:
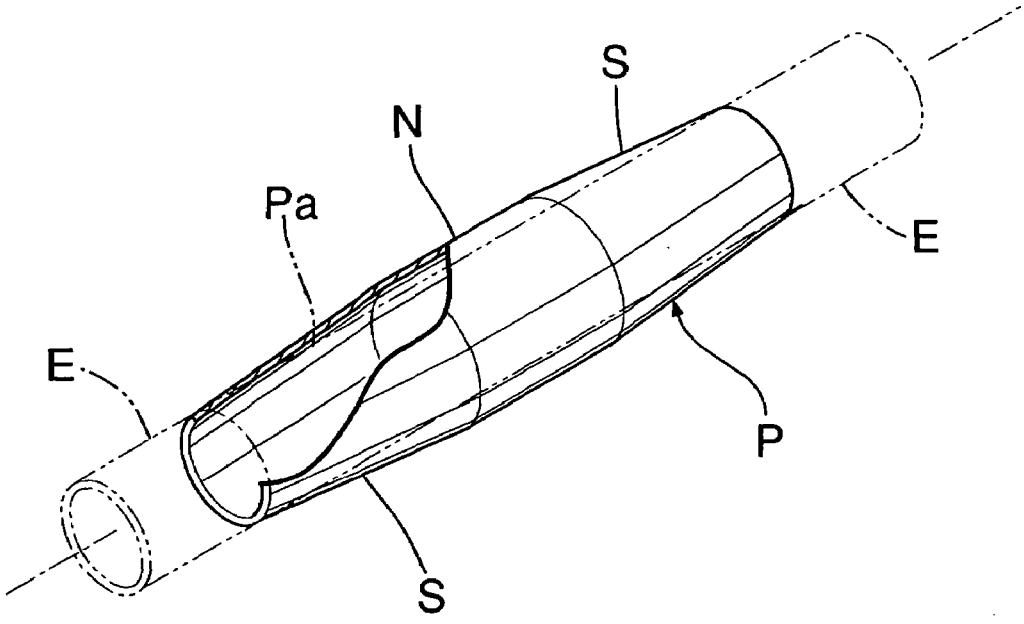

FIG. 5 is a diagram showing production steps for producing a hollow member from a tubular material, and a tubular material Pa prior to processing has a uniform wall thickness of 1.5 t along its whole length in the longitudinal direction as shown in FIG. 5 (*a*).

As shown in FIG. 5 (*b*), the tubular material Pa is subjected to a partial ohmic heating step and an overall ohmic heating step, which are the same as those in the first embodiment, and by controlling the partial heating temperature in the longitudinal direction and controlling the tensile force in a stretch-forming step, an elongated tubular material Pb having a wall thickness of 1.5 t for its middle portion N and a wall thickness of t for its left and right portions S on opposite sides can be obtained.

As shown in FIG. 5 (*c*), the elongated tubular material Pb is subjected to (4) tube expansion (bulge forming) in the same manner as in the first embodiment, and a tube-expanded tube Pc can be obtained, the tube Pc having a middle portion N formed by tube expansion so as to have an enlarged diameter and having a cross-sectional wall thickness of 1.25 t, which is thicker than its left and right portions S on opposite sides thereof, which have a wall thickness of t.

By cutting off opposite end portions E of the tube Pc after tube expansion in the same manner as in the first embodiment, a final molding hollow member P (see FIG. 1) can be obtained.

In accordance with the processes for producing a hollow member of the first and second embodiments above, a hollow member having surplus material cut out can be easily produced by variably controlling the cross-sectional wall thickness in the longitudinal direction and, furthermore, a hollow member having a cross-sectional shape that varies in the longitudinal direction can be simply and easily produced by variably controlling the cross-sectional wall thickness in the longitudinal direction.

As hereinbefore described, in accordance with the first embodiment of the present invention, a hollow member having a cross-sectional wall thickness that is variable in the longitudinal direction can be easily produced.

Furthermore, in accordance with the second invention of the present invention, a hollow member having a cross-sectional shape that varies in the longitudinal direction can be easily produced.

A third embodiment of the present invention is explained with reference to FIGS. 5 to 10.

The third embodiment is a case in which a hollow member having a substantially uniform cross-sectional wall thickness and an expanded tube portion is produced by variably controlling the cross-sectional wall thickness in the longitudinal direction of a tubular material Pa, which is made of an aluminum alloy and has a uniform cross-sectional wall thickness and a uniform diameter in the longitudinal direction, and then carrying out tube expansion (bulge forming), and this process specifically includes (1) a partial ohmic heating step for the tubular material Pa, (2) an overall ohmic heating step for the tubular material Pa, (3) an internal pressurizing and stretch-forming step in which the tubular material Pa is internally pressurized and axially stretched, and (4) a tube-expanding (bulge-forming) step of the elongated tubular material Pb after stretching. These steps are explained in turn below.

Figure 8A:
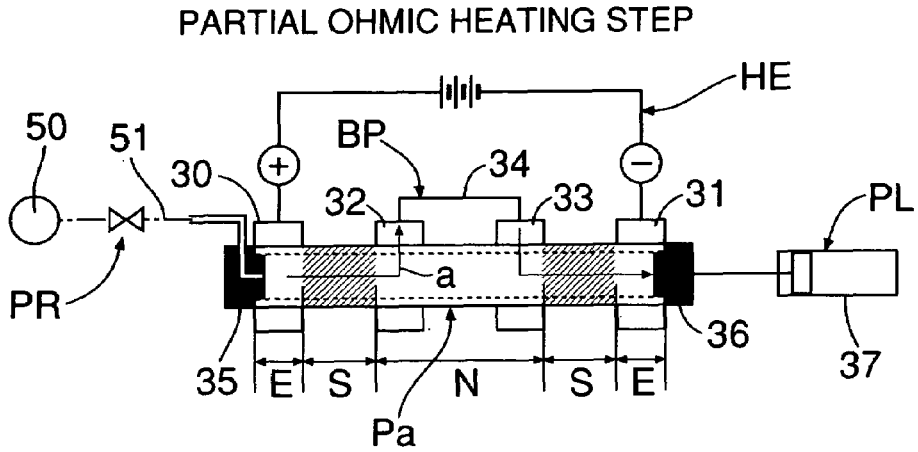
FIG. 8A, FIG. 8B, and FIG. 8C are schematic process charts of a partial ohmic heating step, an overall ohmic heating step, and an internal pressurizing and stretch-forming step.

[(1) Partial Ohmic Heating Step for Tubular Material Pa] (see FIG. 8A)

A tubular material Pa, which has a uniform cross-sectional wall thickness and a uniform cross-sectional shape in the longitudinal direction and is made of an aluminum alloy, is heated in part in the longitudinal direction using heating means such as, for example, ohmic heating means HE. That is, electrically connected to opposite end portions of the tubular material Pa are a + electrode 30 and a – electrode 31 of the ohmic heating means HE, and disposed on the outer peripheral face of a middle portion of the tubular material Pa is current bypass means BP. This current bypass means BP is formed by electrically connecting two low resistance conductors (e.g., copper conductors ) 32 and 33 having lower electrical resistance than that of the aluminum alloy to the longitudinally middle portion of the tubular material Pa so as to encircle it, the two conductors 32 and 33 having a spacing therebetween in the longitudinal direction, and connecting the low resistance conductors 32 and 33 to each other via a lead 34.

The tubular material Pa is provided with seals 36 and 37 for sealing opposite open ends on the left and right thereof and, furthermore, on opposite sides thereof in the axial direction with internal pressurizing means PR for applying an internal pressure to the tubular material Pa in the subsequent internal pressurizing and stretch-forming step and stretching means PL for stretching the tubular material Pa in the axial direction. The internal pressurizing means PR comprises an internal pressurizing source 50 for supplying pressurized air into the interior of the tubular material Pa, and a pressurizing circuit 51 for providing a connection between the internal pressurizing source 50 and the interior of the tubular material Pa. The pressurized air is supplied under pressure from the pressurizing circuit 51 to the interior of the tubular material Pa via one of the seals 35. Furthermore, this stretching means PL is formed from a tensile actuator, that is, a tensile cylinder 37, connected to the seal 36 provided at the other end of the tubular material Pa, and the tubular material Pa is stretched longitudinally in accordance with operation of the tensile cylinder 37.

When the ohmic heating means HE is energized, current flows through the tubular material Pa, the bypass means BP, and then again through the tubular material Pa. That is, since the two low resistance conductors 32 and 33 have a lower electrical resistance than that of the tubular material Pa, which is made of an aluminum alloy, as shown by arrow a in FIG. 8A the current flows through the tubular material Pa while bypassing the hollow portion N of the tubular material Pa, the hollow portion N corresponding to a section between the two low resistance conductors 32 and 33. The portions S on longitudinally opposite sides of the tubular material Pa are therefore heated, and compared with the middle portion N the amount of heat generated therein is relatively large.

In this partial ohmic heating step, the internal pressurizing means PR and the stretching means PL do not operate.

Figure 8B:
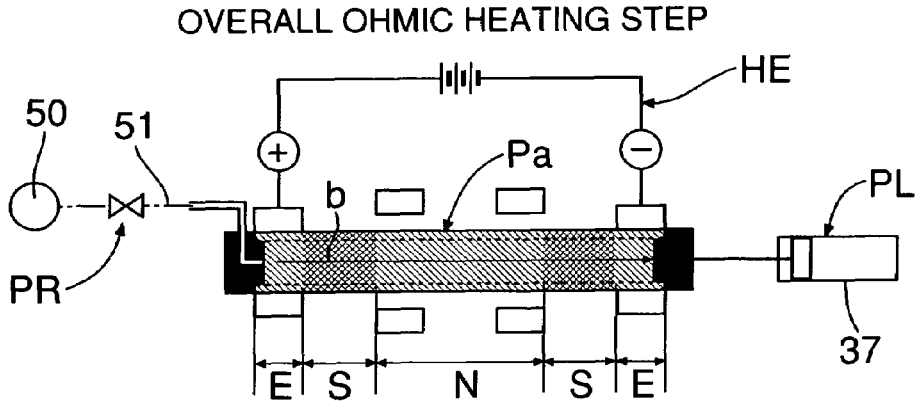

[(2) Overall Ohmic Heating Step for Tubular Material] (see FIG. 8B)

When the portions S on opposite sides of the tubular material Pa have been heated to a higher temperature than that of the middle portion N by the partial heating in the preceding step, the two low resistance conductors 32 and 33 of the current bypass means BP are detached from the tubular material Pa while continuing to operate the ohmic heating means HE. The + electrode 30 and the − electrode 31 of the ohmic heating means HE are thereby electrically connected through the whole length of the tubular material Pa, current flows through the tubular material Pa as shown by arrow b in FIG. 8B, and the tubular material Pa is ohmically heated along its whole length. By the above-mentioned two steps, the left and right portions S on opposite sides of the tubular material Pa are therefore heated to a high temperature, for example, the recrystallization temperature (500° C.) of the tubular material Pa or higher, whereas the middle portion N of the tubular material Pa is heated to a lower temperature.

In this overall ohmic heating step also, the internal pressurizing means PR and the stretching means PL do not operate.

Figure 8C:
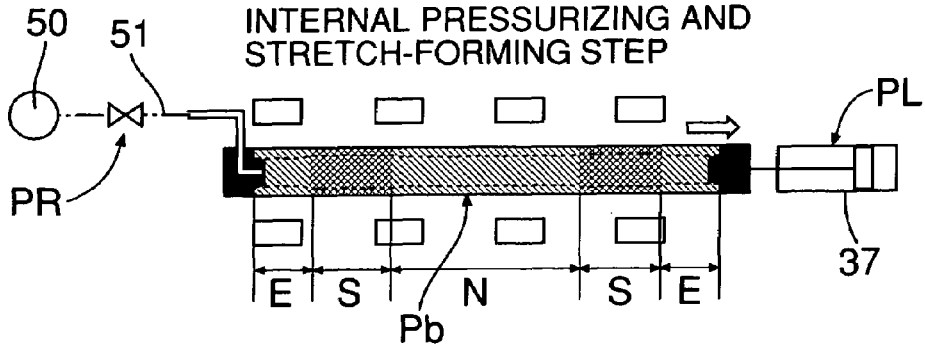
Figure 9:
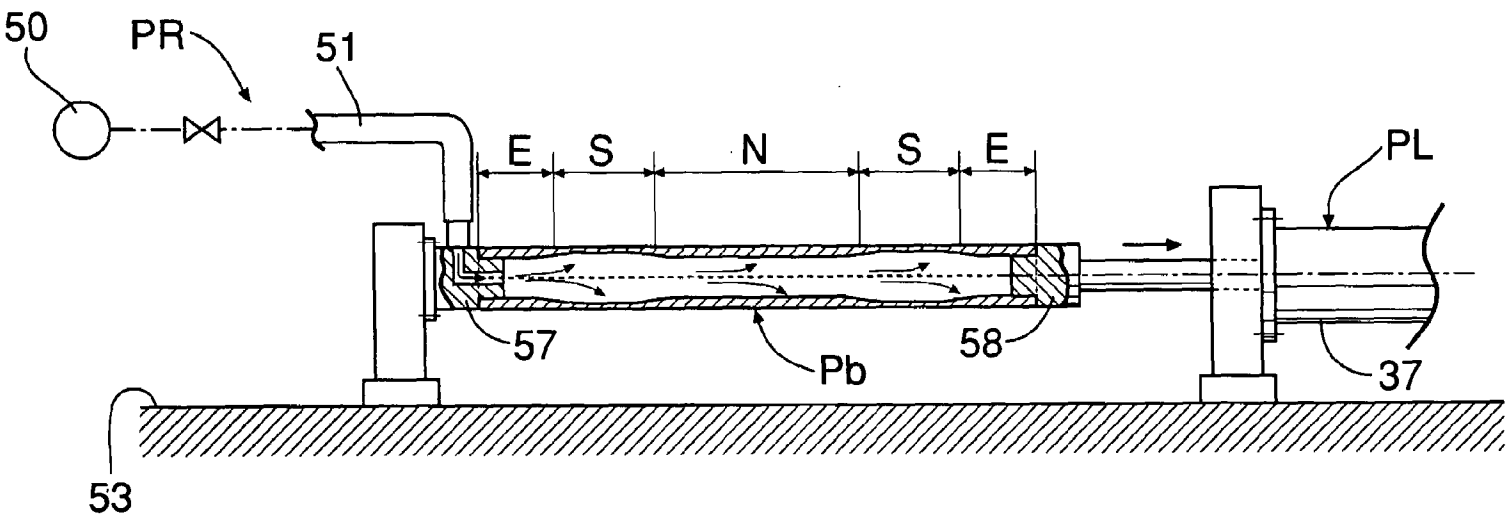

[(3) Internal Pressurizing and Stretch-forming Step for Tubular Material Pa] (see FIG. 8C and FIG. 9)

In the above-mentioned step, the left and right portions S on opposite sides and the middle portion N of the tubular material Pa are heated to a state where they have a predetermined temperature difference, and the internal pressurizing means PR is operated so as to supply pressurized air to the interior of the tubular material Pa and apply a predetermined internal pressure to the interior of the tubular material Pa while operating the stretching means PL so as to apply a predetermined tension to the tubular material Pa in the axial direction. The tubular material Pa is thereby elongated in the axial direction with a predetermined internal pressure being applied to the interior thereof. Since the left and right portions S at opposite ends, which have been heated to a high temperature, have a low resistance to deformation, they elongate quickly and thus have a large amount of elongation, whereas since the middle portion N, which has been heated to a lower temperature, has higher resistance to deformation, it elongates slowly and thus has a small amount of elongation. Moreover, during this stretch-forming step, since the interior of the tubular material Pa is exposed to a predetermined internal pressure because of the pressurized air supplied from the internal pressurizing means PR, even though there is stretching in the axial direction, no 'necking' occurs in the axial direction, and the circumference of the tubular material Pa is maintained substantially uniform along its whole length.

Figure 7:
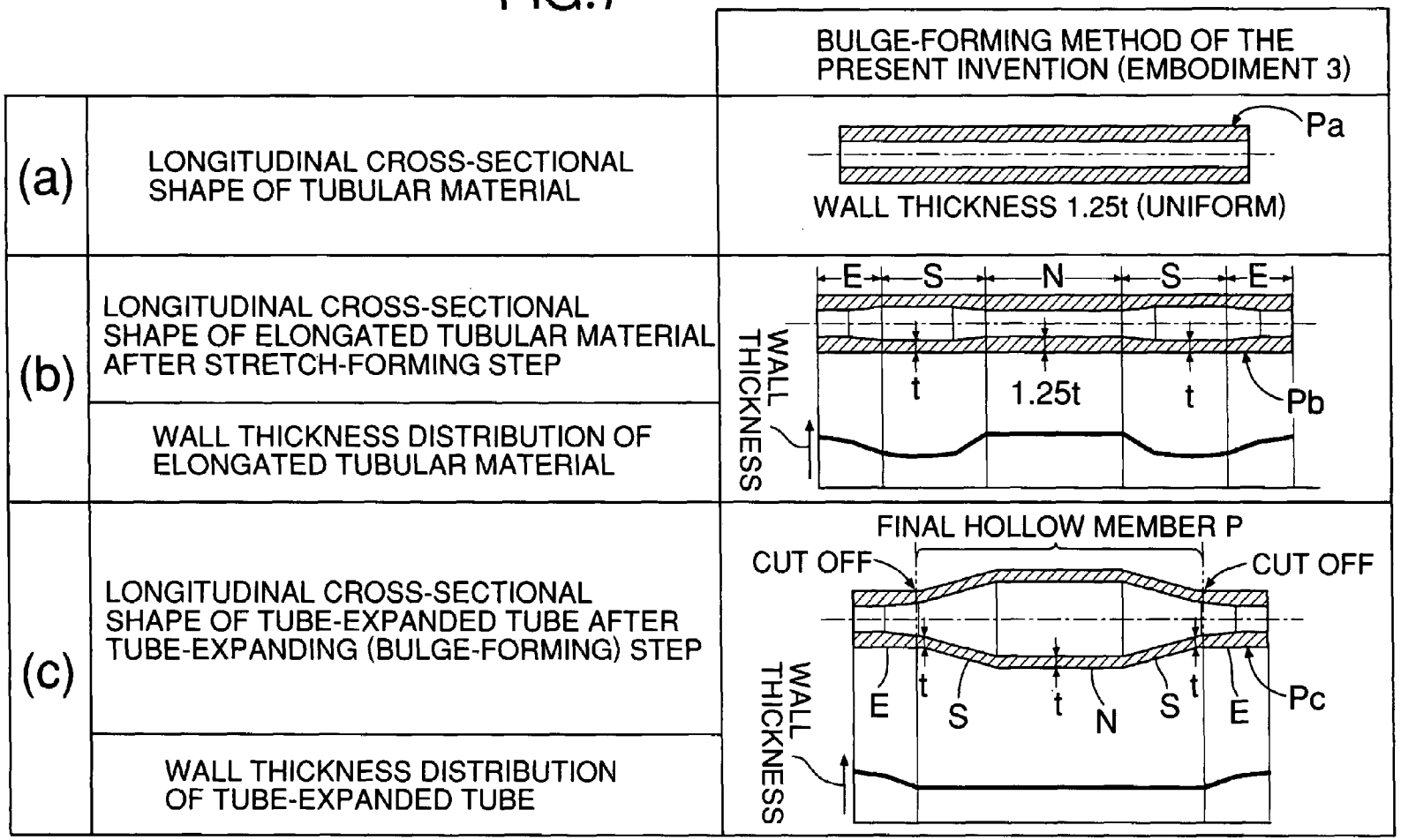

As a result, as shown in FIG. 7 (*c*) and FIG. 9, the cross-sectional wall thickness in the hollow portion N of the elongated tubular material Pb thus elongated in the axial direction is large, that is, 1.25 t, and the cross-sectional wall thickness of the left and right portions S on opposite sides, that is, t, is smaller than that of the hollow portion N. The cross-sectional wall thickness is thus variably controlled, and an elongated tubular material Pb having no 'necking' and a substantially uniform circumference along its whole length can be obtained.

Figure 10:
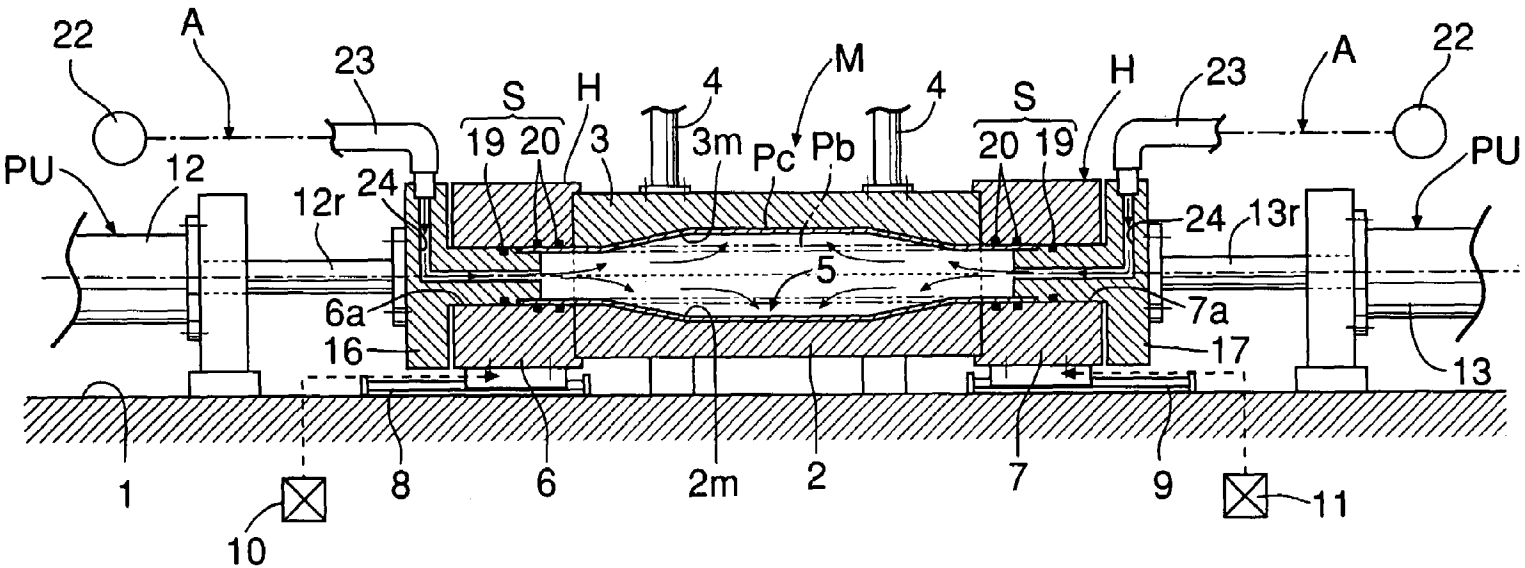

[(4) Tube-expanding (Bulge-forming) Step for Elongated Tubular Material Pb After Stretching] (see FIG. 10)

The elongated tubular material Pb, which has been elongated in the axial direction in the preceding step and has a substantially uniform circumference, is transferred to a tube-expanding (bulge-forming) device by appropriate transfer means.

As shown in FIG. 10, a mold M of the tube-expanding (bulge-forming) device comprises a fixed mold, that is, a lower mold 2, fixedly provided on a base 1 and a mobile mold, that is, an upper mold 3, which faces the fixed mold. Raise/lower cylinders 4 are connected to the top of the mold M, and the upper mold 3 is operated so as to be raised and lowered by expansion/contraction of the raise/lower cylinders 4.

The mold M is a tube-expanding mold and is for subjecting the elongated tubular material Pb, which has been axially elongated in the above step and maintained in a heated state (about 500° C.), to hot tube expansion (hot bulge forming) at the recrystallization temperature thereof or higher. This mold M is heated to about 500° C. by heating means, which is not illustrated.

Formed on the upper face of the lower mold 2 is a lower mold molding surface 2*m*, with which the lower half of the elongated tubular material Pb is molded. Formed on the lower face of the upper mold 3 is an upper mold molding surface 3*m*, with which the upper half of the elongated tubular material Pb is molded. A cavity 5 is formed by the molding surfaces 2*m* and 3*m* when the mold M is closed. Provided on opposite sides on the left and right of the mold M is holding means H for fixing the opposite end portions of the elongated tubular material Pb. The holding means H comprises left and right holders 6 and 7 on the left and right of the mold M; these holders 6 and 7 can be moved forward and backward relative to the mold M, and are controlled by the operation of actuators 10 and 11 so as to move along guides 8 and 9 provided on the base 1. By moving the left and right holders 6 and 7 forward, the opposite end portions of the elongated tubular material Pb are fitted into and fixed to support holes 6*a* and 7*a* of the left and right holders 6 and 7.

Furthermore, provided on opposite sides on the left and right of the mold M is pushing means Pu for axially pushing the elongated tubular material Pb set in the mold M. This pushing means PU has left and right pressure cylinders 12 and 13. Pressing members 16 and 17 secured to the extremities of rod portions 12*r* and 13*r* of these pressure cylinders 12 and 13 are fitted within the support holes 6*a* and 6*b* of the left and right holders 6 and 7 so as to be able to move forward and backward. When the left and right pressure cylinders 12 and 13 are expanded, the extremities of the pressing members 16 and 17 engage with the corresponding opposite ends of the elongated tubular material Pb, and when the pressing members 16 and 17 subsequently move forward, the elongated tubular material Pb is pushed in the axial direction from the opposite ends thereof.

O-rings 19 and 20 as sealing means S are provided respectively between the left and right pressing members 16 and 17 and the support holes 6*a* and 7*a*, and between the support holes 6*a* and 7*a* and outer peripheral faces of the opposite end portions of the elongated tubular material Pb. These O-rings 19 and 20 can provide a fluid tight seal between the elongated tubular material Pb, the holders 6 and 7, and the pressing members 16 and 17 when the pressing members 16 and 17 are engaged with the elongated tubular material Pb.

Provided on opposite sides on the left and right of the mold M1 is compressed air supply means A for pressurizing the interior of the elongated tubular material Pb. This compressed air supply means A is arranged so that compressed air is supplied under pressure from a compressed air supply source 22 to a hermetically sealed hollow portion of the elongated tubular material Pb via a compressed air circuit 23 and an air introduction route 24 bored in the pressing members 16 and 17.

The elongated tubular material Pb, which has been elongated in the preceding step and is still in a heated state (about 500° C.), is placed and set within the mold M, which has been heated similarly to about 500° C., and the mold M is clamped by means of the operation of a mold clamping cylinder, that is, the raise/lower cylinder 4. After opposite end portions of the elongated tubular material Pb are fixed by forward movement of the left and right holders 6 and 7, extending the pressure cylinders 12 and 13 makes the rod portions 12*a* and 13*a* thereof push the tubular material Pa in the axial direction, and pressurized air is supplied into the tubular material Pa from the compressed air source 22 via the compressed air supply route 23 and the air introduction route 24 while carrying out the axial pushing. Applying an internal pressure to the elongated tubular material Pb in this way subjects the elongated tubular material Pb to hot tube expansion (hot bulge forming) so that it follows the upper and lower molding surfaces 3*m* and 2*m* of the cavity 5.

The elongated tubular material Pb after tube expansion is taken out of the mold M by opening the mold M after the left and right holders 6 and 7 are moved backward, and a tube-expanded tube (bulge-formed tube) Pc is obtained as shown in FIG. 7 (*c*). In this way, this tube-expanded tube Pc is formed in a shape having an enlarged portion comprising the hollow portion N, left and right tapered and truncated cone portions comprising the left and right portions S on opposite sides, which extend leftward and rightward from the enlarged portion, and left and right end portions E, which extend from the cone portions and have not been subjected to tube expansion (bulge forming), and the left and right end portions E are cut off to give a final molding, that is, a hollow member P (see FIG. 6).

With regard to the elongated tubular material Pb, which has been subjected to the above-mentioned partial heating, overall heating, and internal pressurizing and stretch-forming steps described in (1) to (3), as shown in FIG. 7(*b*), the cross-sectional wall thickness of the left and right portions S on opposite sides is t, and the cross-sectional wall thickness of the middle portion N is 1.25 t, which is thicker than t and, moreover, the outer peripheral face thereof has no 'necking' along its whole length and has a uniform circumference.

By subjecting this elongated tubular material Pb to tube expansion (bulge forming) of the above (4), as shown in FIG. 7 (*c*), the middle portion N thereof is radially elongated to a larger extent than that to which the left and right portions S on opposite sides are elongated, thus forming an enlarged diameter portion, and the tube Pc after tube expansion therefore has a substantially uniform wall thickness t along the whole length thereof. As a result, the final molding after tube expansion, from which the left and right end portions E have been cut off, that is, the hollow member P, is a tube-expanded tube Pc having a substantially uniform cross-sectional wall thickness t along its whole length even though the cross-sectional shape has been changed by tube expansion. In accordance with this third embodiment, the defect of the conventional tube-expanding (bulge-forming) method, that is, the cross section of the bulge-formed portion becoming thin, can be eliminated.

A fourth embodiment of the present invention is now explained with reference to FIG. 11.

Figure 11:
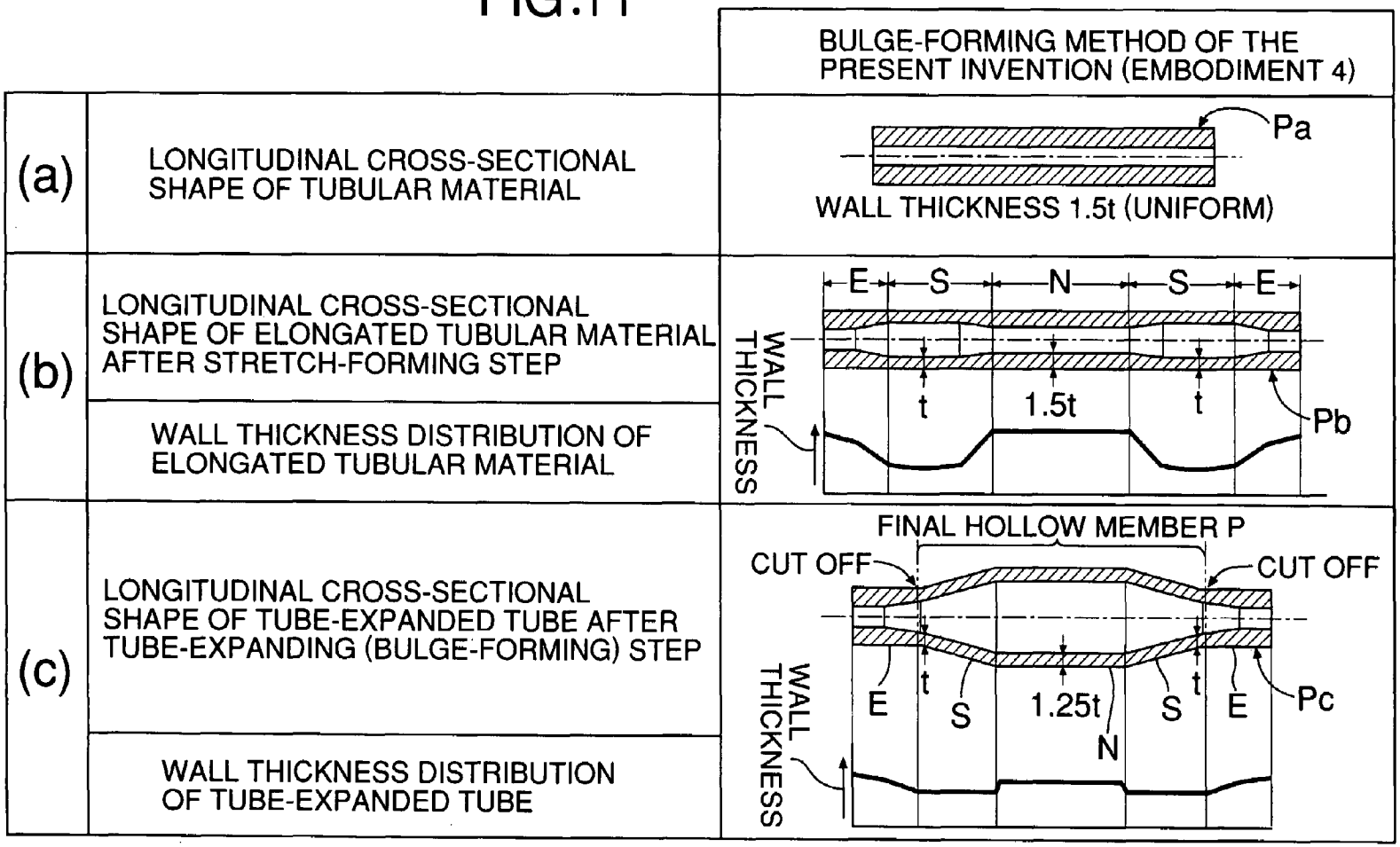
FIG. 11 shows a fourth embodiment of the present invention and is a diagram showing production steps of producing a hollow member from a tubular material.

FIG. 11 is a diagram showing production steps for producing a hollow member from a tubular material, and a tubular material Pa prior to processing has a uniform wall thickness of 1.5 t along its whole length in the longitudinal direction as shown in FIG. 11 (*a*). As shown in FIG. 11 (*b*), the tubular material Pa is subjected to a partial ohmic heating step and an overall ohmic heating step, which are the same as those in the third embodiment, and by controlling the partial heating temperature in the longitudinal direction, and controlling the internal pressure and the tensile force in an internal pressurizing and stretch-forming step, an elongated tubular material Pb having a uniform circumference without 'necking' and having a wall thickness of 1.5 t for its middle portion N and a wall thickness of t for its left and right portions S on opposite sides can be obtained.

As shown in FIG. 11 (*c*), the elongated tubular material Pb is subjected to (4) tube expansion (bulge forming) in the same manner as in the third embodiment, and a tube-expanded tube Pc can be obtained, the tube Pc having a middle portion N formed by tube expansion so as to have an enlarged diameter and having a cross-sectional wall thickness of 1.25 t, which is thicker than the left and right portions S on opposite sides thereof, which have a wall thickness of t.

By cutting off opposite end portions E of the tube Pc after tube expansion in the same manner as in the third embodiment, a final molding hollow member P (see FIG. 6) can be obtained.

A fifth embodiment of the present invention is now explained with reference to FIG. 12.

Figure 12:
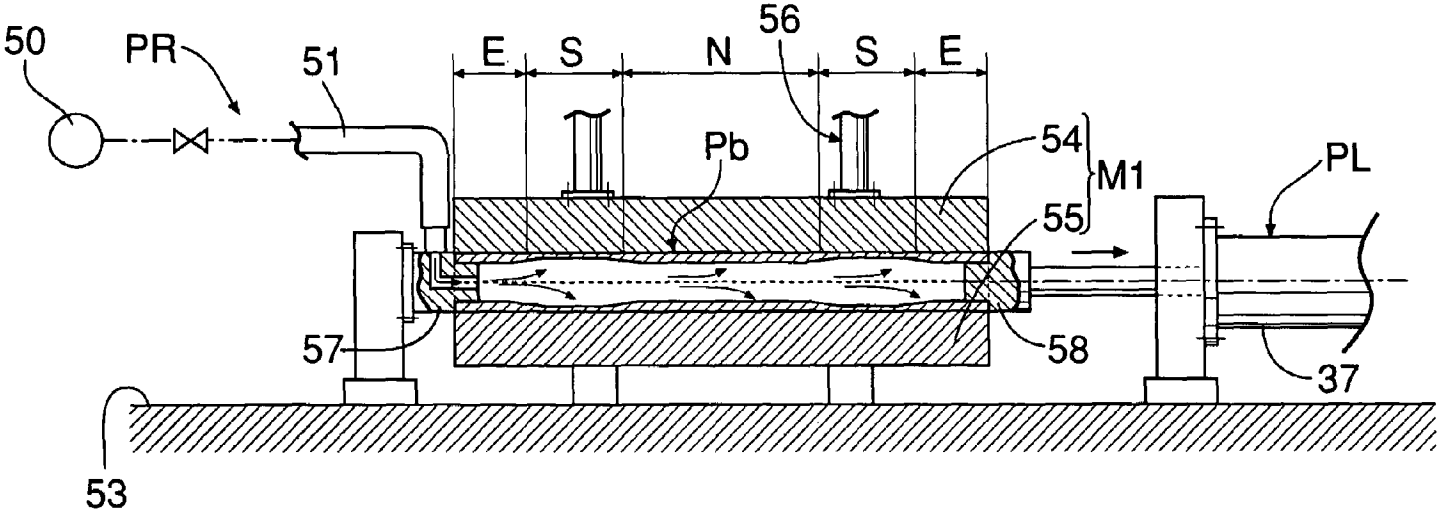
FIG. 12 shows a fifth embodiment of the present invention and is a cross-sectional view of an internal pressurizing and stretch-forming device.

FIG. 12 is a cross-sectional view of an internal pressurizing and stretch-forming device for a tubular material. In this fifth embodiment, a partial heating step (1) for a tubular material Pa, an overall ohmic heating step (2) for the tubular material Pa, and a tube-expanding (bulge-forming) step (4) for the elongated tubular material Pb of the above third embodiment are the same as in the first embodiment, but specific arrangements of an internal pressurizing and stretch-forming step (3) for the tubular material Pa are different from those of the third embodiment. That is, in accordance with this fifth embodiment, as shown in FIG. 12, the axial stretch-forming step of the heated tubular material Pa with internal pressure applied thereto is carried out within a mold M1; the occurrence of partial 'necking' on the outer peripheral face during stretching of the tubular material Pa can be prevented more reliably and, moreover, the circumference thereof can be made uniform along its whole length. The specific arrangements thereof are explained below with reference to FIG. 12. The tubular material Pa, which has been heated with a temperature variation in the longitudinal direction via the preceding heating step (its left and right portions S on opposite sides are at a recrystallization temperature (500° C. or more), and its middle portion N is at lower temperature than the above), is set in a mold M1 for internal pressurizing and stretching. This mold M1 comprises a lower mold 55 fixed on top of a base 53, and an upper mold 54 that can be raised and lowered relative to the lower mold 55, the upper mold 54 being connected to raise/lower cylinders 56 so as to be able to be raised and lowered. The mold M1 is maintained at an appropriate temperature so that the tubular material Pa, which is in a partially heated state, is maintained in that heated state. Provided at one open end of the tubular material Pa (left-hand end portion in FIG. 12) is a seal 57 for sealing said one open end, and provided at the other open end of the tubular material Pa (right-hand end portion in FIG. 7) is another seal 58 for sealing said other open end. Said other seal 58 is connected to a tensile cylinder 37 of stretching means PL. Furthermore, disposed in said one end portion of the mold M1 is internal pressurizing means PR for pressurizing the interior of the tubular material Pa to a predetermined pressure. This internal pressurizing means PR is arranged so that pressurized air from an internal pressurizing source 50 is supplied under pressure to the interior of the tubular material Pa via a pressurizing circuit 51.

The tubular material Pa set within the mold M1 has its internal pressure maintained at a predetermined pressure as a result of the supply of pressurized air from the internal pressurizing means PR and is subjected to a predetermined tension in the axial direction by operation of the tensile cylinder 37 of the stretching means PL. This causes the tubular material Pa to be elongated, and during this process, in the same manner as in the above third embodiment, left and right portions S on opposite sides, which are heated to a high temperature, elongate quickly and thus have a large amount of elongation, whereas a middle portion N, which is heated to a low temperature, has a small amount of elongation, thereby giving an elongated tubular material Pb having a cross-sectional wall thickness that varies in the axial direction.

In accordance with this fifth embodiment, when stretching the tubular material Pa, since the tubular material Pa is subjected to a predetermined internal pressure and the external shape thereof is restricted to a uniform shape by the mold M1, no 'necking' is formed in the tubular material Pa, and an elongated tubular material Pb having a uniform circumference along its whole length can be formed with good precision.

The elongated tubular material Pb after stretching is subjected to the tube-expanding (bulge-forming) step of the first embodiment, and a tube-expanded product having a variable shape in a cross section orthogonal to the longitudinal direction can thus be obtained.

In accordance with the above third to fifth embodiments, a hollow member having a cross-sectional wall thickness that is variable in the longitudinal direction or having a cross-sectional shape that varies in the longitudinal direction can be produced and, in particular, an elongated tubular member having no partial 'necking' and having a substantially uniform circumference along its whole length can be precisely and easily produced by stretching a tubular material in the axial direction with an internal pressure applied thereto.

Although embodiments of the present invention are explained above, the present invention is not limited to these embodiments and various embodiments are possible within the scope of the present invention.

For example, the above-mentioned embodiments describe cases in which the forming process of the present invention is applied to a hollow member made of an aluminum alloy, but this can of course be applied to a hollow member that is made of another metal, and in this case the heating temperatures for the tubular material and the mold are controlled according to the material of the tubular member, etc. Furthermore, in these embodiments, air is used as a compressible fluid for applying internal pressure to the tubular material, but another fluid can be used.

What is claimed is:

1. A process for producing a hollow member having a wall thickness, in a cross section orthogonal to the longitudinal direction, that varies in the longitudinal direction, the process comprising:

a heating step of heating a tubular material (Pa) so that the tubular material (Pa) is given a temperature variation in the longitudinal direction; and a stretching step of axially stretching the tubular material (Pa) that has been heated in the preceding step.

2. A process for producing a hollow member having a shape, in a cross section orthogonal to the longitudinal direction, that varies in the longitudinal direction, the process comprising:

a heating step of heating a tubular material (Pa) so that the tubular material (Pa) is given a temperature variation in the longitudinal direction;

a stretching step of axially stretching the tubular material (Pa) that has been heated in the preceding step; and a tube-expanding step of tube expanding an elongated tubular material (Pb), which has had its wall thickness in a cross section orthogonal to the longitudinal direction varied in the longitudinal direction in the preceding step, by setting the elongated tubular material (Pb) within a cavity (5) of a mold (M) and applying an internal pressure to the elongated tubular material (Pb).

3. A process for producing a hollow member having a wall thickness, in a cross section orthogonal to the longitudinal direction, that varies in the longitudinal direction, the process comprising:

a heating step of heating a tubular material (Pa) so that the tubular material (Pa) is given a temperature variation in the longitudinal direction; and a stretching step of applying an internal pressure to the tubular material (Pa) that has been heated in the preceding step and axially stretching the tubular material (Pa).

4. A process for producing a hollow member having a shape, in a cross section orthogonal to the longitudinal direction, that varies in the longitudinal direction, the process comprising:

a heating step of heating a tubular material (Pa) so that the tubular material (Pa) is given a temperature variation in the longitudinal direction;

a stretching step of applying an internal pressure to the tubular material (Pa) that has been heated in the preceding step and axially stretching the tubular material (Pa); and a tube-expanding step of tube expanding an elongated tubular material (Pb), which has had its wall thickness in a cross section orthogonal to the longitudinal direction varied in the longitudinal direction in the preceding step, by setting the elongated tubular material (Pb) within a cavity (5) of a mold (M) and applying an internal pressure to the elongated tubular material (Pb).

* * * * *